US005478010A

United States Patent [19]

Vaucher

[11] Patent Number: 5,478,010

[45] Date of Patent: Dec. 26, 1995

[54] MAILING ENVELOPE

[75] Inventor: Claude Vaucher, Zürich, Switzerland

[73] Assignee: VA+ST Group Sicherheit AG, Zurich, Switzerland

[21] Appl. No.: 266,224

[22] Filed: Jun. 27, 1994

[30] Foreign Application Priority Data

Jul. 9, 1993 [EP] European Pat. Off. ..... 93111001

[51] Int. Cl.[6] ..... B65D 27/30

[52] U.S. Cl. ..... 229/80; 229/71; 383/5

[58] Field of Search ..... 383/5, 66, 78, 383/106; 229/71, 80

[56] References Cited

U.S. PATENT DOCUMENTS

| | | | |
|---|---|---|---|
| 4,483,018 | 11/1984 | Whelan | 383/5 |
| 5,108,194 | 4/1992 | Raden | 383/5 |

FOREIGN PATENT DOCUMENTS

| | | | |
|---|---|---|---|
| 0459012 | 12/1991 | European Pat. Off. | 383/5 |
| 3342256 | 6/1985 | Germany | 383/5 |
| 2138396 | 10/1984 | United Kingdom | 383/5 |
| 92/14655 | 9/1992 | WIPO | 383/5 |

*Primary Examiner*—Jes F. Pascua
*Attorney, Agent, or Firm*—Ladas & Parry

[57] ABSTRACT

The mailing envelope includes a front sheet portion and a back sheet portion. A folded back flap adjoins the front sheet portion which projects into the interstice between the front and the back sheet portion. The mailing envelope is closed by an adhesive material strip which joins the back sheet portion to the folded back flap. The mailing envelope includes, furthermore, lateral folded over flaps by which the front sheet portion of the envelope is bonded to the back sheet portion. A portion of a bonding material is placed at the free edge of each flap which portion projects visibly at the free edge of the flap and has a color which visibly contracts the color of the sheet portions. A further correspondingly colored adhesive material portion is located at the bottom of the fold area between the front sheet portion and the folded over flaps. If the mailing envelope is severed non-authorized at the adhesive material portions in order to steal its contents and is closed thereafter the unauthorized tampering is usually shown by fault areas at the corresponding portions of the adhesive material. An identification marking is printed onto the folded back flap which marking is repeated on an extension strip connected releasably via a perforation to the mailing envelope.

6 Claims, 1 Drawing Sheet

MAILING ENVELOPE

BACKGROUND OF THE INVENTION

1. Field of the Invention

The present invention relates to a mailing envelope having measures for a visible indication of a tampering and an unauthorized manipulation at the envelope, which envelope includes a front sheet portion of a first color and a rear sheet portion formed integral with the front sheet portion and having the same first color, which front sheet portion has two opposite edges, both integrally connected via a fold over area to a respective flap which folded over flaps are joined by means of an adhesive material to the second sheet portion, which flaps include, therefore, a fold edge and a free edge located opposite of the fold edge.

2. Description of the Prior Art

When using mailing envelopes which contain means of financial transactions, valuables, documents which are not intended for third parties etc. there is the danger that they are opened during their transport, their contents stolen and thereafter closed again in such a manner, that the recipient does not immediately recognize the loss and the tampering made at the envelope.

Such a tampering can consist for instance in that a sharp blade is inserted between one sheet portion and the lateral flap bonded on this sheet portion and than a cut is made along the area of contact, for instance along the areas which are bonded together by a bonding agent. In order to again bond the cut areas together a adhesive is placed between the areas severed from each other by mentioned cut and thus these areas are again glued to each other.

According to a further possibility the area of the fold or crease, respectively, between a sheet portion and a folded over flap is cut in order to steal the contents out of the severed envelope and thereafter this fold area is again glued.

Such and similar tampering cannot be recognized or seen, respectively directly when receiving a shipment and accordingly a corresponding loss is often discovered to late.

SUMMARY OF THE INVENTION

A general object of the invention is to provide an envelope of the kind set forth above of which the adhesive material used is of a second color which contrasts the first named color of the sheet portions and is present in two portions of which a first portion is located in such a manner along the respective free edge of the respective flaps that the part thereof is located outwards adjacent the free edges such to be visible as line-like strip extending adjacent and along the respective free edges, and a second portion of which is located at the bottom the crease present at the fold edge.

If such an envelope is cut upon in that the folded over flap is severed from the respective sheet portion onto which it has been bonded by the adhesive, a re-bonding will be clearly visible due to the mechanical damaging of the projecting portion of the adhesive material and possibly also by relocations of individual areas of the bonding agent portion. The same effect is arrived also when the envelope is cut upon along a folded over area, i.e. the crease between the bonded flap and the adjacent sheet portion because also in such an instance a damaging of the adhesive material will lead to the above mentioned directly visible effect.

BRIEF DESCRIPTION OF THE DRAWINGS

The invention will be better understood and objects other than those said forth above, will become apparent when consideration is given to the following detailed description thereof. Such description makes reference to the annext drawings wherein.

DESCRIPTION OF THE PREFERRED EMBODIMENT

This particular embodiment of the invention refers to a mailing envelope made of paper. Such mailing envelope can, however, be made from a material different from paper, such as for instance of cardboard or a plastic material.

Figure 2:
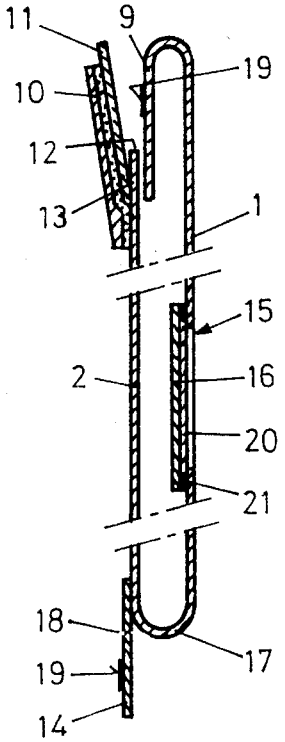
FIG. 2 is a section along the line II—II of FIG. 1.
Figure 3:
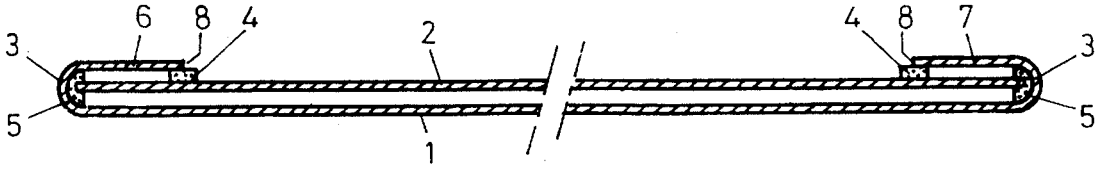
FIG. 3 is a section along the line III—III of FIG. 1.

The mailing envelope includes a front sheet portion 1 and a back sheet portion 2 formed integrally with the first sheet portion 1 at a fold or crease, respectively area 17. This fold area 17 which is visible in FIG. 2 is obviously generally known as a sharp edged fold and is designated in FIG. 2 with a rather large radius only for reasons of clear identification. The same is also true for the illustration of FIG. 3.

At the upper edge of the front sheet portion 1 as designed in FIG. 2 a folded back flap 9 is present contiguous with the front sheet portion 1. This folded back flap 9 projects into the interstice between the front sheet portion 1 and the back sheet portion 2. FIG. 2 discloses, furthermore, that seen in the direction of hight of the mailing envelope the second, that is back sheet portion 2 is shorter than the first, that is front sheet portion 1 such that mentioned folded back flap 9 can be inserted into mentioned interstice quite easily.

The mailing envelope of this embodiment is equipped additionally with an extension strip 14 which can be used for instance for a confirming of the receipt of the shipment. This extension strip 14 can be severed from the actual mailing envelope along a perforation 18. It must, however, be noted that not all embodiments of the invention must include this extension strip 14. On the other hand, embodiments having a plurality of such extension strips 14 are foreseen, in which case all such extension strips are limited relative to each other and relative to the envelope by means of perforations.

A identification marking 19 is printed onto the folded back flap 9, for instance a number or a bar code etc., which identification marking, see 19*a*, is repeated on the extension strip 14.

A strip of an adhesive 10 is applied adjacent the upper free edge 12 of the back sheet portion 2 at a distance from this free edge 12 onto the back sheet portion 2 in such a manner that a freely exposed strip 13 extends directly along the edge 12 of this sheet portion 2. The reference numeral 11 denotes the removable pull-off protective strip located on the e.g. pressure sensitive adhesive material of the adhesive strip 10.

A viewing window 15 for allowing a reading of an address printed for instance on a letter present in the envelope is arranged in the front sheet portion 1 which viewing window 15 is covered at the inner side of the envelope by a transparent foil 20 such as generally known in the prevailing art.

This transparent foil 20 is bonded by means of an adhesive to the sheet portion which adhesive is also arranged and composed in such a manner that it also indicates visibly a tampering. It may for instance be the same adhesive material which is used for a bonding of the flaps 6 or 7 or it may be a different, generally known tamper proof safety adhesive material or it may be of such a kind which discolors when being exposed to a solvent.

In the illustrated embodiment of the envelope the viewing window 15 is covered by an opaque covering sheet 16 which is bonded by means of an adhesive material 21 to the inner side of the front sheet portion 1. This covering sheet 16 is used in such cases where the contents of the mailing envelope shall not be visible through the viewing window 15. The structure of this covering sheet 16 including its adhesive material 21 can be the same as the self adhering memo pads which usually are of a yellow color and are used in offices ("Memo Block"). In a basic embodiment the mailing envelope can be purchased including the covering sheet 16 located behind the viewing window 15 whereby in case this covering sheet 16 is not necessary it can be removed without further ado due to the only weakly adhering, pressure sensitive adhesive material 21.

Figure 1:
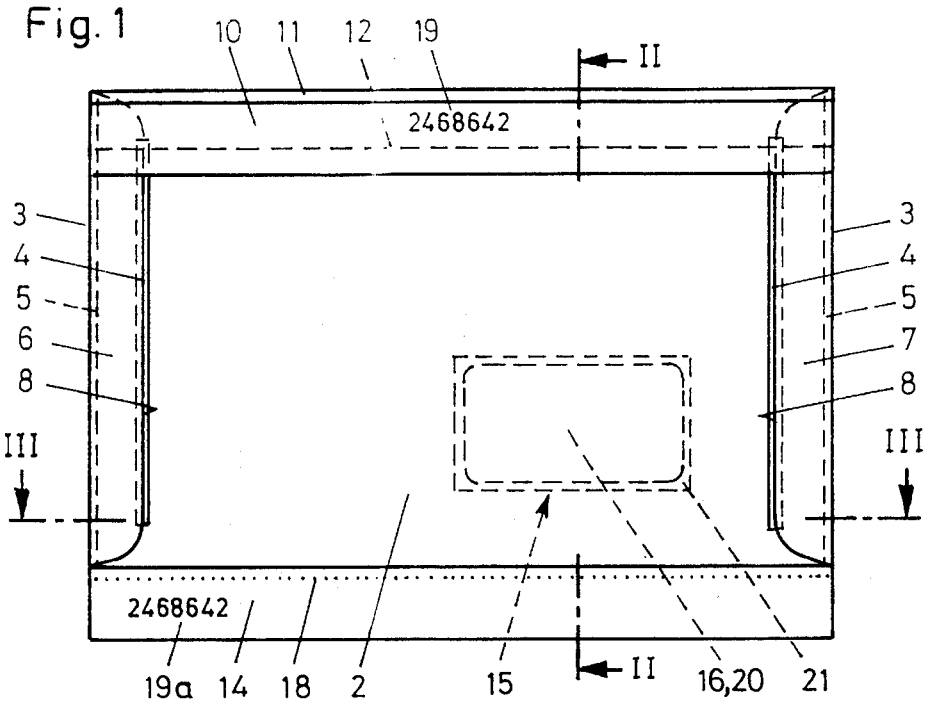
FIG. 1 is a view of the back side of an envelope structured in accordance with this invention.

In order to close the mailing envelope the protective pull-off strip is removed from the strip of adhesive 10 and the latter pressed towards the upper, free exposed strip 13 of the back sheet portion 2 and against the folded back flap 9. This insures the impeccable closing of the mailing envelope. Attention is now drawn to FIGS. 1 and 3. The front sheet portion 1 is connected to the back sheet portion 2 by flaps 7 joining both sides of the front sheet portion 1 at the fold area 3. The adhesive material forming the bond is of a color which contrasts the color of the entire mailing envelope. If the mailing envelope is for instance of a white color this adhesive material can be of a yellow color. This adhesive material is, furthermore, of such a kind which discolors when subjected to a solvent in case a tampering is attempted by other than a mechanical destruction of the flaps 7 such to create an access to the contents of the mailing envelope. Such adhesive materials are generally known and available on the market.

At the free edge 8 of the flap 7 a first, strip like portion of an adhesive material is present which portion is identified by the reference numeral 4. This adhesive material portion is disposited now in such a manner that it projects beyond the edge 8 of the flap 7 such that it can be seen from the outside of the envelope as a line-like colored strip. A further portion 5 of the adhesive material is placed in the bottom of the crease, that is of the folded area 3. The same arrangement of the adhesive material is obviously also to be found at the side of the flap 6.

If now for an unauthorized opening, that is tampering of the mailing envelope a blade is inserted between the back sheet portion 2 and the flap 7 and thus a cut is made through the portion 4 of the adhesive material, it will be impossible when re-closing the envelope to fit the destroyed section 4 together in such a manner that the manipulation which has been made goes unnoticed.

The same is now true for the adhesive material portion 5 at the fold area 3. Also here a damaging of the adhesive material 5 made once cannot be re-installed in such a manner that it goes unnoticed. The area which has been re-assembled or of which the previously severed portions are again fitted together will always be recognizable by visible disturbances and faults at the corresponding section of adhesive material, augmented by the clear visibility due to the contrasting coloring of the adhesive material.

Although the illustrated embodiment is described with reference to two separate adhesive material portions 4 and 5, it is also possible to foresee under the respective flaps 6 and 7 only one adhesive material area extending uninterrupted from the outer, free edge 8 to the base of the fold 3, the crease.

Finally it is to be noted, that the terms "upper", "lower", "front", "back" used in the above exemplary description are not to be understood in a limiting sense but rather to have an explanatory character for a clear disclosure.

While there is shown in described a present preferred embodiment of the invention it is to be distinctly understood that the invention is not limited thereto but may be otherwise variously embodied and practiced within the scope of the claims.

I claim:

1. A mailing envelope having measures for a visible indication of a tampering and unauthorized manipulation of the envelope, said envelope including a front sheet portion of a first color and a rear sheet portion formed integral with the front sheet portion and having two opposite free edges, both integrally connected via a fold over area to a respective flap, each flap is joined by means of an adhesive material to the rear sheet portion, each flap includes a fold edge and a respective one of said free edges located opposite of the fold edge, said adhesive material is of a second color which contrasts with said first color of said sheet portions and is present in first and second, spaced portions; said first spaced portion being located along and outward of the free edge of each flap, such as to be visible as line-like strips extending adjacent and along the respective free edges, and said second spaced portion being located at the fold edge of each flap.

2. The mailing envelope of claim 1, wherein the rear sheet portion is shorter than its front sheet portion to define a folded back flap in the front sheet portion which projects between the front sheet portion and the rear sheet portion.

3. The mailing envelope of claim 2, in which a strip of an adhesive material covered by a pull-off protective strip is mounted to and extends from the back sheet portion at an upper free edge, said strip of adhesive material being adapted to be joined after removal of the pull-off protective strip to said folded back flap.

4. The mailing envelope of claim 1, including at least one sheet-like extension strip adapted to be printed and written upon such as to record a confirmation of receipt, said sheet-like extension strip being releasably connected to one of said sheet portions.

5. The mailing :envelope of claim 1, including an address viewing window having a transparent foil located in the front sheet portion, wherein said transparent foil is joined to the front sheet portion by an adhesive agent which renders a tampering therewith visible or discolors if contacted by a solvent, and wherein an opaque covering sheet is releasably adhered to an inverse side of the front sheet portion for selective covering of the address viewing window.

6. The mailing envelope of claim 2, including at least one sheet-like extension strip adapted to be printed and written upon such as to record a confirmation of receipt, said sheet-like extension strip being releasably connected to one of said sheet portions, said envelope further comprising an identification marking on the folded back flap, which is repeated on said at least one sheet-like extension strip.

* * * * *